US010894277B2

(12) United States Patent
Sasaki et al.

(10) Patent No.: US 10,894,277 B2
(45) Date of Patent: Jan. 19, 2021

(54) ROLLING BENDING METHOD AND ROLLING BENDING APPARATUS

(71) Applicant: DENSO CORPORATION, Kariya (JP)

(72) Inventors: Chiaki Sasaki, Kariya (JP); Kenta Tateyama, Kariya (JP); Hidemasa Otsubo, Kariya (JP); Kengo Takeshita, Kariya (JP)

(73) Assignee: DENSO CORPORATION, Kariya (JP)

( * ) Notice: Subject to any disclaimer, the term of this patent is extended or adjusted under 35 U.S.C. 154(b) by 229 days.

(21) Appl. No.: 15/843,306

(22) Filed: Dec. 15, 2017

(65) Prior Publication Data

US 2018/0281035 A1 Oct. 4, 2018

(30) Foreign Application Priority Data

Apr. 3, 2017 (JP) ..... 2017-073669

(51) Int. Cl.
*B21B 1/24* (2006.01)
*B21D 5/14* (2006.01)

(52) U.S. Cl.
CPC . *B21B 1/24* (2013.01); *B21D 5/14* (2013.01)

(58) Field of Classification Search
CPC ..... B21D 5/14; B21D 11/10; B21D 11/203; B21D 5/08; B21D 5/083; B21D 11/20; B21D 13/04; B21D 53/16; B21D 53/18; B21H 8/02; B21H 1/02; B21B 27/02; B21B 27/021; B21B 2027/022; B21B 1/12; B21B 1/14; B21B 2261/046
USPC ..... 72/166, 168, 169, 234; 492/27
See application file for complete search history.

(56) References Cited

U.S. PATENT DOCUMENTS 2,134,526 A * 10/1938 McLaughlin ..... B21H 8/00 72/187
3,882,709 A * 5/1975 Kawamoto ..... B21B 37/38 72/234
4,338,807 A * 7/1982 Ricono ..... B21B 1/02 72/187
4,445,353 A * 5/1984 Taleff ..... H02K 15/026 29/605

(Continued)

FOREIGN PATENT DOCUMENTS

JP H02-084217 A 3/1990
JP H11-169992 A 6/1999

(Continued)

OTHER PUBLICATIONS

Campbell, Elements of Metallurgy and Engineering Alloys, 2008, ASM International, p. 349 (Year: 2008).*

*Primary Examiner* — Adam J Eiseman
*Assistant Examiner* — Stephen Floyd London

(57) ABSTRACT

A steel strip is fed and compressed between a driving roller and a compression roller to generate a stress greater than a yield stress in the steel strip and to elongate one periphery portion of the steel strip, which is on one side, more than the other periphery portion of the steel strip, which is on the other side, in a sending direction. The compression roller includes a first contact portion and a second contact portion. The second contact portion extends from an end of the first contact portion in the axial direction of the compression roller. The end of the first contact portion has an outer diameter less than an outer diameter of the second contact portion.

9 Claims, 10 Drawing Sheets

(56) References Cited

U.S. PATENT DOCUMENTS

| | | | | |
|---|---|---|---|---|
| 4,926,566 | A * | 5/1990 | McMurtry | G01B 3/004 33/493 |
| 6,308,549 | B1 * | 10/2001 | Tokizawa | H02K 15/026 72/136 |
| 2002/0116973 | A1 * | 8/2002 | Wilhelm | B21D 53/88 72/166 |
| 2005/0061046 | A1 * | 3/2005 | Koshizaka | H02K 1/16 72/136 |
| 2011/0094085 | A1 * | 4/2011 | Sakurai | B21H 8/00 29/527.1 |
| 2011/0302982 | A1 * | 12/2011 | Weaver, Jr. | B21D 5/14 72/173 |
| 2015/0174641 | A1 * | 6/2015 | Otsubo | B21D 13/02 72/379.6 |
| 2017/0297092 | A1 * | 10/2017 | Brown | C21D 8/0247 |
| 2018/0099323 | A1 * | 4/2018 | Tachibana | B21B 1/09 |

FOREIGN PATENT DOCUMENTS

| | | | |
|---|---|---|---|
| JP | 2006-217692 | A | 8/2006 |
| JP | 2012-240113 | A | 12/2012 |

* cited by examiner

ROLLING BENDING METHOD AND ROLLING BENDING APPARATUS

CROSS REFERENCE TO RELATED APPLICATION

This application is based on Japanese Patent Application No. 2017-73669 filed on Apr. 3, 2017, the disclosure of which is incorporated herein by reference.

TECHNICAL FIELD

The present disclosure relates to a rolling bending method. The present disclosure further relates to a rolling bending apparatus.

BACKGROUND

A rolling bending process is known as a manufacturing method for a pressed component in an annular shape. In the rolling bending process, a steel strip is rolled with an inclined roller, and the steel strip is bent in the board width direction. Patent Literature 1 teaches a method for manufacturing a stator of a rotary device by performing a rolling bending work.

(Patent Literature 1)

Japanese published unexamined application No. 2006-217692

It is noted that, the characteristics of the material of the steel strip such as yield stress may vary. Because of the variation in such as yield stress, the steel strip, which has been processed with the rolling bending work, may vary in its curvature.

SUMMARY

It is an object of the present disclosure to produce a rolling bending method. It is another object of the present disclosure to produce a rolling bending apparatus.

According to an aspect of the present disclosure, a rolling bending method is for rolling a steel strip between a driving roller and a compression roller while bending the steel strip in a width direction of the steel strip. The method comprises feeding, in a feeding process, the steel strip between the driving roller and the compression roller. The method further comprises compressing, in a rolling process, the steel strip by using the driving roller and the compression roller to generate a stress greater than a yield stress in the steel strip to elongate one periphery portion of the steel strip more than an other periphery portion of the steel strip in a sending direction. The one periphery portion is on one side in the width direction of the steel strip. The other periphery portion is on an other side in the width direction. The method further comprises sending out, in a sending-out process, the steel strip from a work space between the driving roller and the compression roller. The compression roller includes a first contact portion and a second contact portion. The first contact portion is to compress the steel strip. The second contact portion extends from an end of the first contact portion in an axial direction of the compression roller. The end of the first contact portion has an outer diameter less than an outer diameter of the second contact portion.

According to another aspect of the present disclosure, a rolling bending apparatus is configured to roll a steel strip while bending the steel strip in a width direction of the steel strip. The rolling bending apparatus comprises a driving roller configured to receive a torque from an actuator to feed the steel strip. The rolling bending apparatus further comprises a compression roller including a first contact portion and a second contact portion. The first contact portion is configured to compress the steel strip. The second contact portion extends from an end of the first contact portion in an axial direction of the compression roller. The end of the first contact portion has an outer diameter less than an outer diameter of the second contact portion. The rolling bending apparatus further comprises a compression part configured to move the compression roller toward the driving roller to cause the first contact portion and the second contact portion to generate a stress greater than a yield stress in the steel strip.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1A:
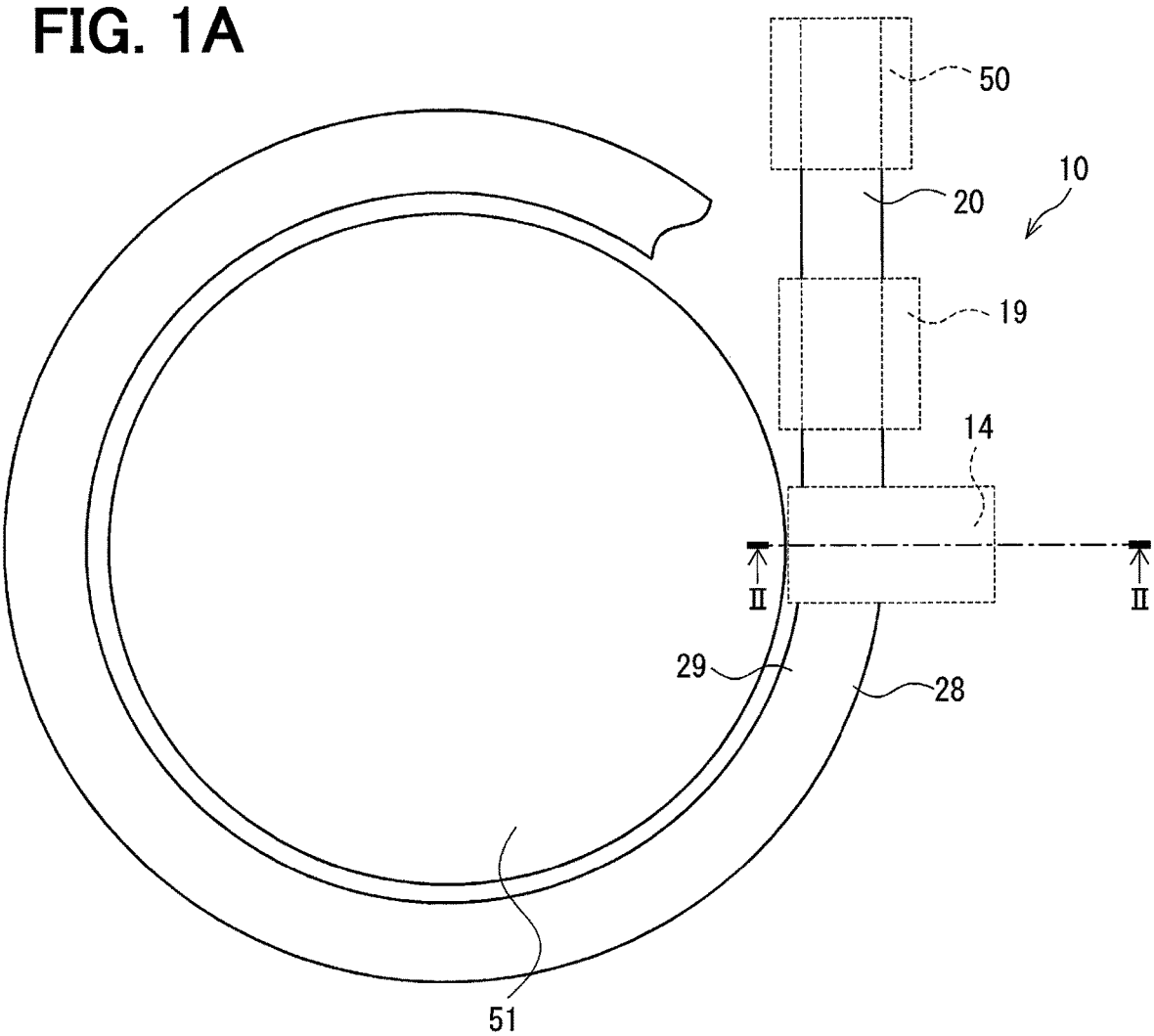
FIG. 1A is a plan view showing a rolling bending apparatus according to a first embodiment.

As follows, embodiments of a rolling bending process and a rolling bending apparatus according to the present disclosure will be described with reference to drawings. In the following multiple embodiments, the same reference numeral will be denoted to the same element, and description of the same element will be omitted.

First Embodiment

Figure 1B:
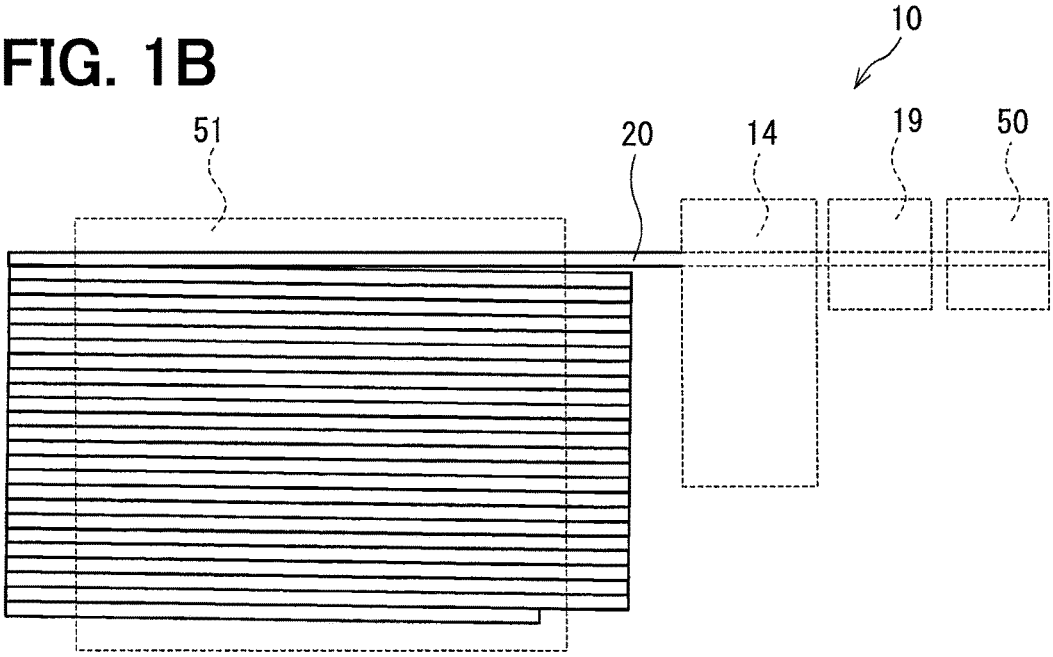
FIG. 1B is a front view showing the rolling bending apparatus.

The rolling bending apparatus will be described with reference to FIGS. 1 and 2. In the following description, the gravity direction is supposed a lower direction, and the opposite direction to the gravity direction is supposed an upper direction. FIG. 1A is a plan view showing the rolling bending apparatus 10. FIG. 1B is a front view showing the rolling bending apparatus 10. The rolling bending apparatus 10 includes a driving roller 11, a driving part 15, a cam 17, a compression roller 12, a compression part 16, a feeder guide 19, an uncoiler 50, and a wind-up part 51. The driving roller 11 is a flat roller having a cylindrical surface 111 which makes contact with a steel strip 20. The driving roller 11 is equipped to a holder 14 to which the rolling bending apparatus 10 is mounted. The driving roller 11 is rotational about a rotational axis center X1. The driving part 15 is a motor to generate a torque. The driving part 15 is feedback-controlled to increase and decrease its rotational speed. The cam 17 converts the torque of the driving part 15 and transmits the converted torque to the driving roller 11.

Figure 2:
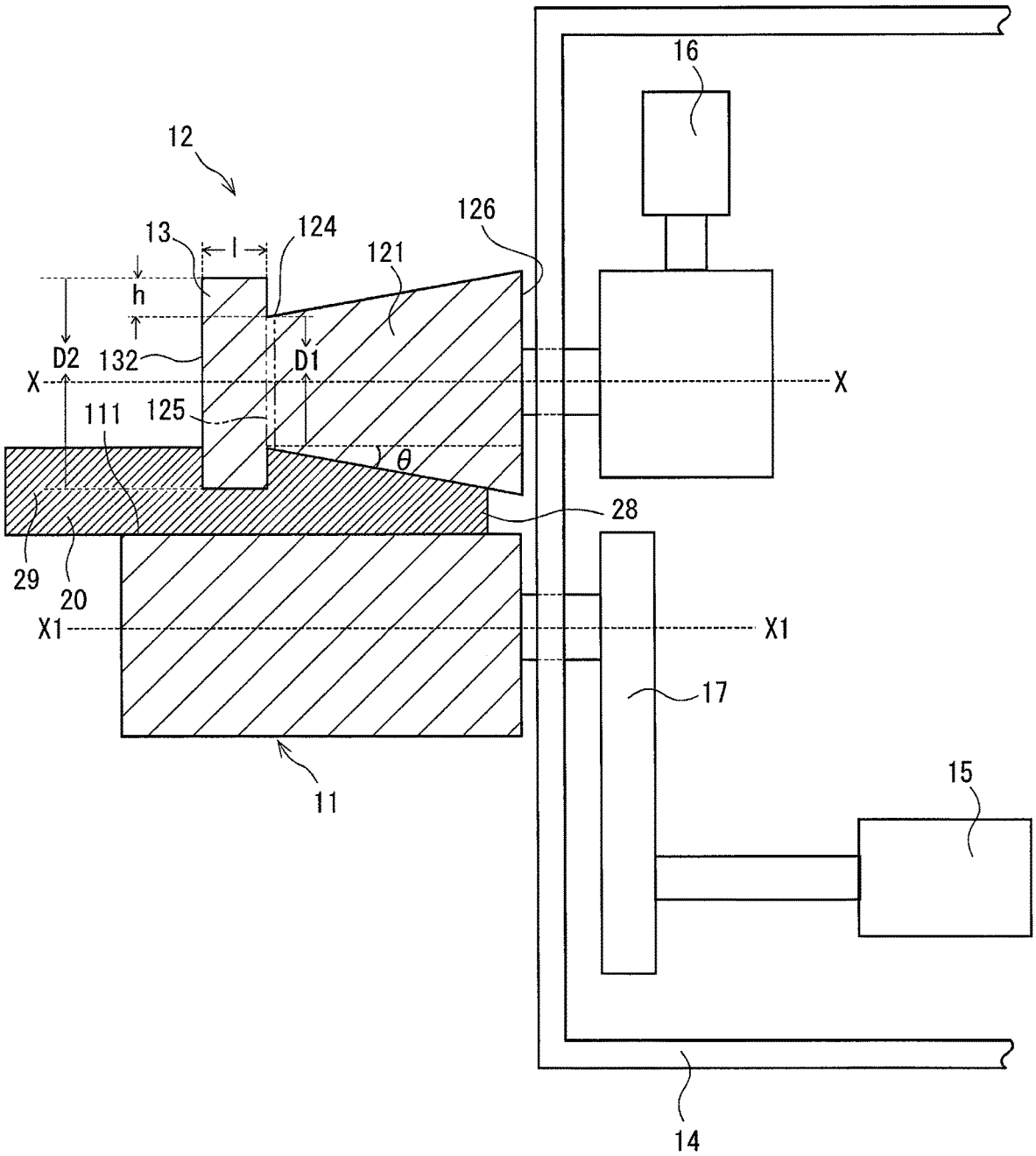
FIG. 2 is a sectional view taken along a line II-II in FIG. 1A.

As shown in FIG. 2, the compression roller 12 includes a column portion 121 and an projected portion 13. The column portion 121 may be equivalent to a first contact portion. The projected portion 13 may be equivalent to a second contact portion. The column portion 121 is in a chamfered conical shape having a cross section in a trapezoidal shape. The column portion 121 being in the chamfered conical shape has a greater outer diameter at a bottom surface 126. The column portion 121 is equipped such that the bottom surface 126 is opposed to the holder 14. The holder 14 is for attachment of the compression roller 12 to the rolling bending apparatus 10. The column portion 121 has a surface at an inclination angle e relative to a rotational axis center X of the column portion 121 being a chamfered conical object. The projected portion 13 is in a column shape having a cylindrical surface. The projected portion 13 extends from a bottom surface 125 of the column portion 121 along a roller axis of the column portion 121. The bottom surface 125 of the column portion 121 is a smaller one of the two bottom surfaces of the chamfered-conical-shaped column portion 121. The rotational axis center X of the projected portion 13 coincides with the rotational axis center X of the column portion 121. The projected portion 13 has a non-connecting surface 132 at which the projected portion 13 is not connected with the column portion 121. In the present embodiment, the rotational axis center X1 of the driving roller 11 and the rotational axis center X of the compression roller 12 are parallel to each other. The column portion 121 includes an adjacent portion 124 which is adjacent to the projected portion 13. The adjacent portion 124 may be equivalent to an end portion. The two-point chain line shows a region of the adjacent portion 124. An outer diameter D2 of the projected portion 13 is greater than an outer diameter D1 of the adjacent portion 124. The outer diameter D1 of the adjacent portion 124 is substantially equal to the diameter of the bottom surface 125. The projected portion 13 is projected by a projected portion height h in a direction perpendicular to the rotational axis center X. The projected portion 13 has a projected portion length l along the rotational axis center X. The surface of the column portion 121 is inclined at the inclination angle e. The projected portion height h, the projected portion length l, the inclination angle e, and the like are determined according to an actual product.

The compression part 16 is configured with, for example, an air cylinder and/or a hydraulic system. The compression part 16 is configured to move the compression roller 12 in the vertical direction thereby to change the length between the driving roller 11 and the compression roller 12 in the vertical direction. In this way, the compression part 16 is configured to change a compression force exerted on the steel strip 20. The feeder guide 19 is configured to position the steel strip 20 with respect to the board width direction (width direction) and to send out the steel strip 20 smoothly with reduced rattle. In the following description, the board width direction is a direction perpendicular to the sending direction. The board width direction is within a board surface. The uncoiler 50 is wound with the steel strip 20. The uncoiler 50 is configured to send out the steel strip 20 continuously at a constant speed. The wind-up part 51 is configured to rotate while moving downward in synchronization with a speed of the steel strip 20 being sent out. In this way, the wind-up part 51 is configured to wind the manufactured steel strip 20 in a spiral form.

Rolling work is performed on the steel strip 20 by using the driving roller 11 and the compression roller 12. The column portion 121 is directed to the projected portion 13 in a first direction. The steel strip 20 is not exerted with the compression force from the compression roller 12 on the side beyond the non-connecting surface 132 of the projected portion 13 in the first direction. Therefore, the rolling work is terminated and is not performed at the portion of the steel strip 20 on the side beyond the non-connecting surface 132. One periphery portion 28 of the steel strip 20 with respect to the board width direction is further elongated along the sending direction than the other periphery portion 29 of the steel strip 20. The elongated periphery portion 28 is on the radially outer side in a bending work. The position, at which the projected portion 13 is in contact with the steel strip 20 with respect to the board width direction, is determined for each actual product. The steel strip 20 being processed with the bending work can be laminated in a spiral form.

Subsequently, a rolling bending process will be described. The rolling bending process is to produce a product, in which the steel strip 20 is laminated in an annular form, by using the rolling bending apparatus 10 according to the present embodiment.

A preparation process at step S1 will be described. The steel strip 20 is first prepared. The steel strip 20 is to be processed with a continuous work. In order to reduce fluctuation in curvature of the product produced with the continuous work, it is necessary to maintain the thickness, the width, a yield stress and/or the like of the steel strip regularly at constant values, respectively. However, it is difficult to maintain all the figures at the constant values in reality. The steel strip 20 as prepared actually has a certain fluctuation in the thickness, the width, the yield stress, and/or the like in dependence on a production lot.

A feeding process at step S2 will be described. The steel strip 20 is drawn from the uncoiler 50 by using a driving device (not shown). The steel strip 20 being drawn is rectified in the form and is aligned at a constant position with respect to the board width direction by using the feeder guide 19. The steel strip 20 is sent into the rolling bending apparatus 10.

A rolling process at step S3 will be described. A rolling bending work is continuously performed on the steel strip 20. Parameters, such as the rotational speed of the driving roller 11, the shape of the compression roller 12, the compression force exerted in the rolling work, the working position in the steel strip 20 with respect to the board width direction, are beforehand computed for each product. Specifically, a stress generated in the steel strip 20 by using the column portion 121 is set to be greater than the yield stress of the steel strip 20. Subsequent to the rolling bending work, a portion of the steel strip 20 having rolled with the column portion 121 is on an radially outer side, and a portion of the steel strip 20 having rolled with the projected portion 13 is on an radially inner side.

A sending-out process at step S4 will be described. The steel strip 20 having processed with the rolling bending work is sent out from the rolling bending apparatus 10 and is wound around the wind-up part 51 to be in a spiral form.

A cutting process at step S5 will be described. A working length of the steel strip 20 is acquired from a counter equipped to the feeder guide 19, by multiplying a sending speed by an elapsed time, and/or the like. Subsequent to performing the rolling bending work on the steel strip 20 by a predetermined length, the steel strip 20 having processed with the rolling bending work and wound around the wind-up part 51 is cut. The steel strip 20 is removed from the wind-up part 51. Through the above-described process, the steel strip 20 is annularly laminated to be a product.

As follows, the product of the steel strip 20 will be described. As the product, the steel strip 20 has been processed with the rolling bending work by using the rolling bending apparatus 10 according to the present embodiment.

Figure 3A:
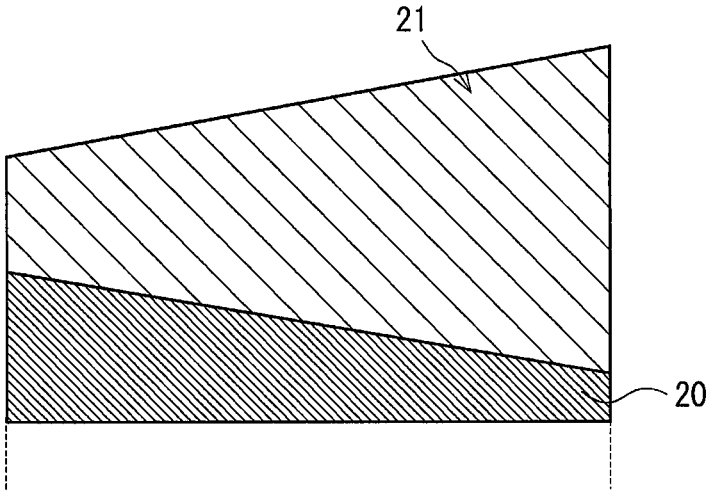
FIGS. 3A, 3B, and 3C are views showing a rolling bending work.
Figure 3B:
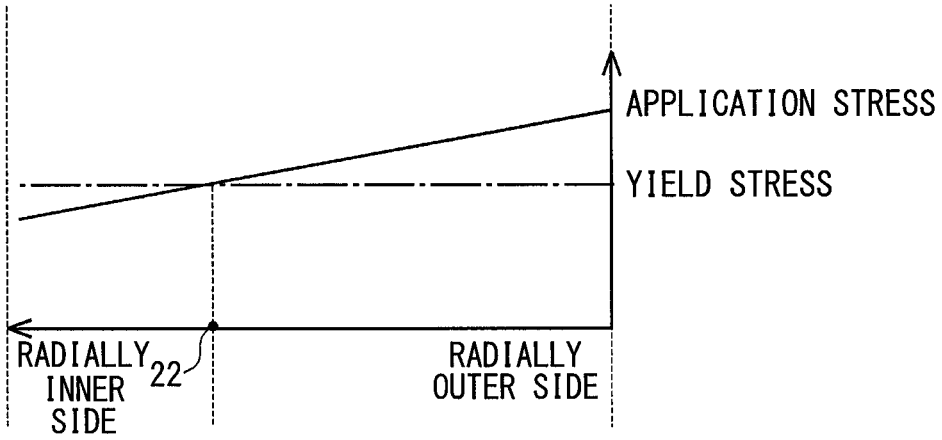
Figure 3C:
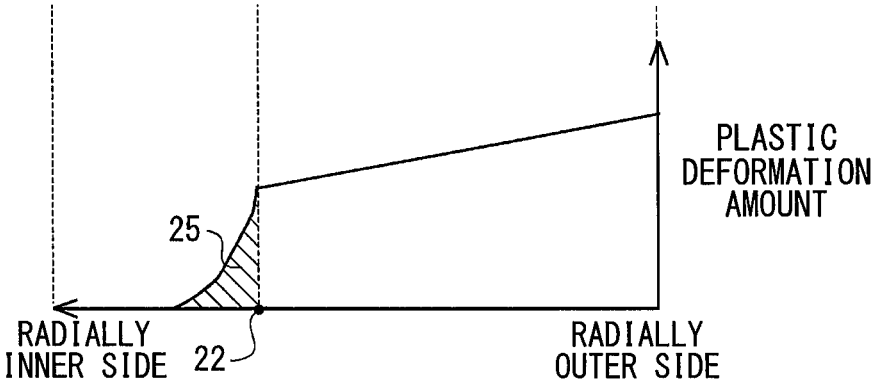

FIG. 3A is an explanatory view showing a comparative example of the present embodiment. In this comparative example, a rolling bending work is performed on the steel strip 20 by using an ordinary compression roller 21 having an inclined portion. Herein, the cross section in FIG. 3A is taken along a surface, which is perpendicular to the sending direction of the steel strip 20 which is processed with the rolling bending work. The cross sections in FIG. 4B to FIG. 7, which will be described later, are supposed to be taken along the same surface as that of FIG. 3A. FIG. 3B shows a relationship between the stress generated in the steel strip 20 and the position in the steel strip 20 with respect to the board width direction. At a point 22, an application stress shown by the solid line intersects with the yield stress of the steel strip 20 shown by the one-point chain line. The steel strip 20 is plastically deformed on the radially outer side of the point 22 as a boundary. The steel strip 20 is elastically deformed on the radially inner side of the point 22. FIG. 3C shows a relationship between an amount of plastic deformation of the steel strip 20 and a position with respect to the board width direction. In a region in which the steel strip 20 elastically deforms, a stress greater than the yield stress is not generated in a portion of the steel strip 20 in the rolling work by using the compression roller 21. Therefore, the portion of the steel strip 20 is not supposed to plastically deform. However, the portion of the steel strip 20 deforms following to the plastic deformation in reality. The amount of deformation is shown by the hatched area as a follow-up deformation amount 25.

Subsequently, a relationship between the rolling bending work and the curvature of the steel strip 20 will be described. FIGS. 4 A and 4B show a relationship between the sectional shape of the steel strip 20, which is bent through the rolling bending work, and the curvature.

Figure 4A:
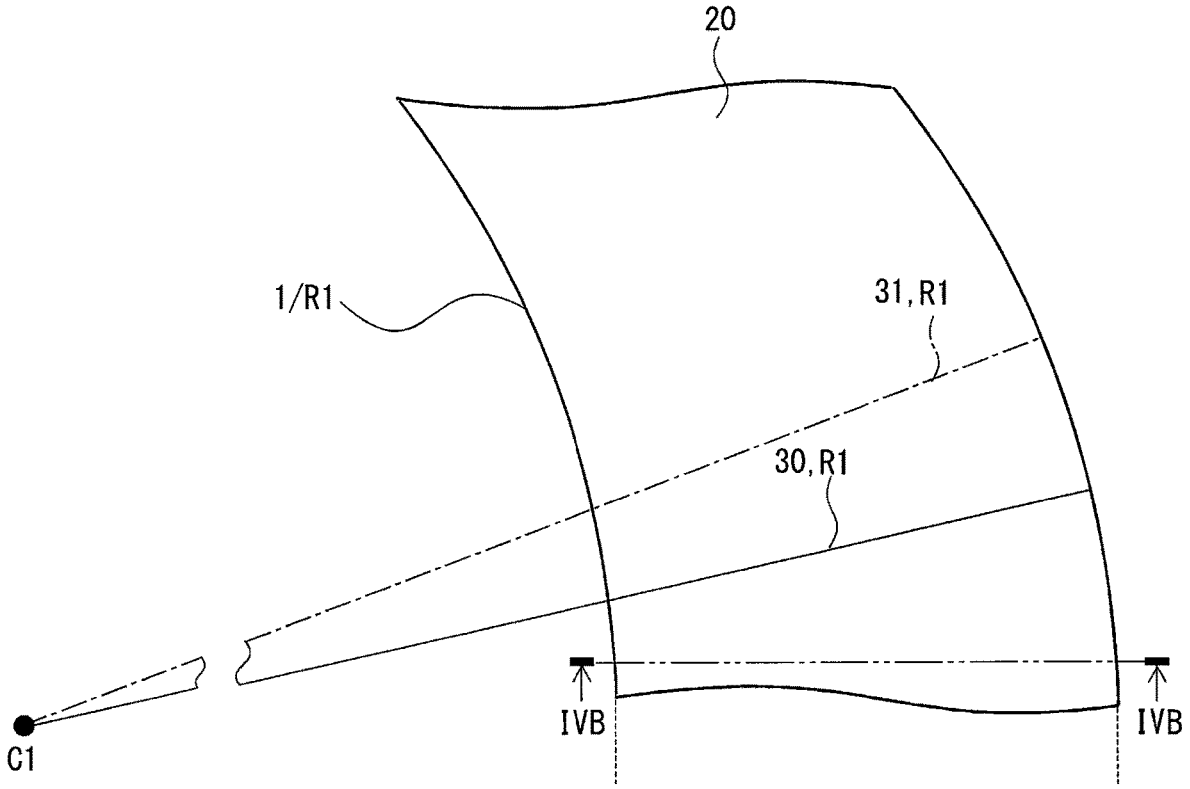
FIGS. 4A and 4B are views showing the rolling bending work.

In FIG. 4A, the steel strip 20 has a radius R1 represented by the solid line 30 and by the one-point chain line 31. The curvature is 1/R1. The solid line 30 and the one-point chain line 31 have a common center C1.

Figure 4B:
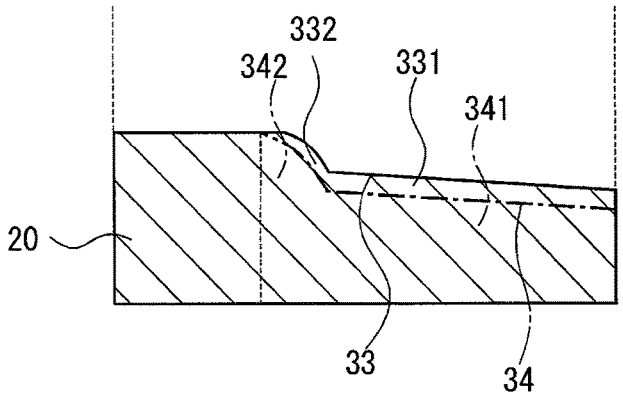

In FIG. 4B, the solid line 33 shows the cross section of the steel strip 20 having the radius R1 at the section along the solid line 30 in FIG. 4A. In FIG. 46, the one-point chain line 34 shows the cross section of the steel strip 20 having the radius R1 at the section along the one-point chain line 31 in FIG. 4A. The cross section shown by the solid line 33 includes an inclination deformed portion 331 and a follow-up deformed portion 332. The inclination deformed portion 331 is a portion formed with the inclined portion of the compression roller 21. The cross section shown by the one-point chain line 34 includes an inclination deformed portion 341 and a follow-up deformed portion 342. The inclination deformed portion 341 is a portion formed with the inclined portion of the compression roller 21. As shown in FIG. 4B, a ratio of the amount of deformation of the inclination deformed portion 331 to the amount of deformation of the follow-up deformed portion 332 is the same as a ratio of the amount of deformation of the inclination deformed portion 341 to the amount of deformation of the follow-up deformed portion 342. In this case, the steel strip 20 has the same curvature even though the cross sections differ from each other.

Figure 5A:
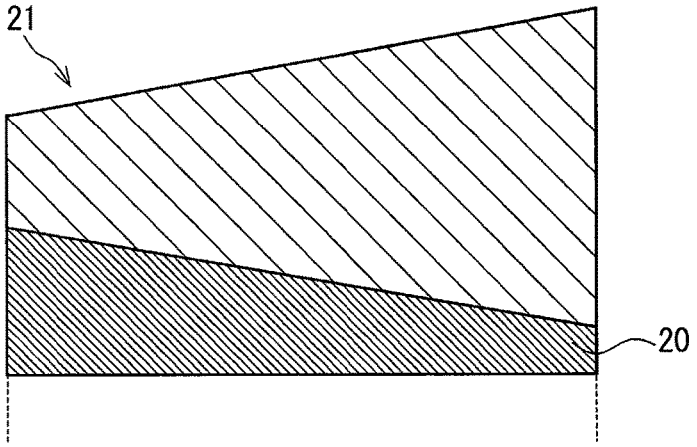
FIGS. 5A, 5B, and 5C are views showing the rolling bending work.
Figure 5B:
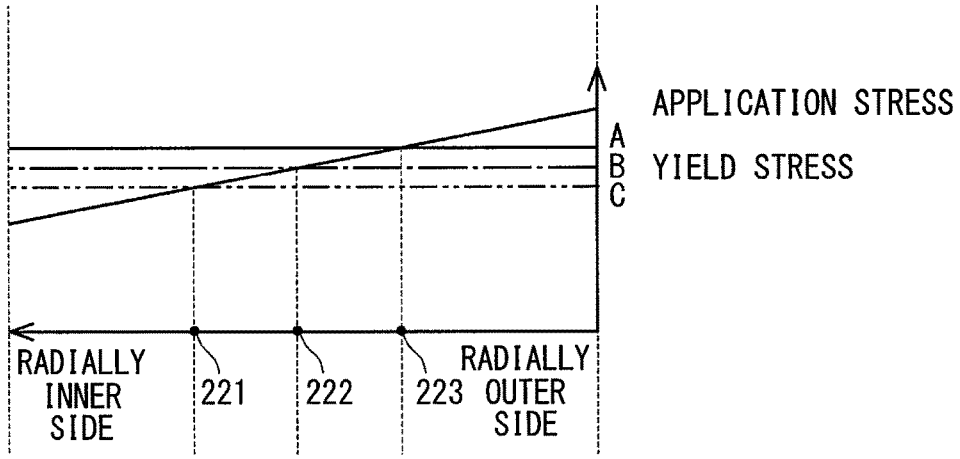

FIG. 5A is an explanatory view showing the steel strip 20 rolled by using the ordinary compression roller 21 in a case where the yield stress of the steel strip 20 varies. FIG. 5B shows a relationship between the stress generated in the steel strip 20 and the position in the steel strip 20 with respect to the board width direction. Suppose that the yield stress of the steel strip 20 varies from A (MPa) through B (MPa) to C (MPa). When stress is generated during the rolling bending work, the yield stress C (MPa) shown by the two-point chain line intersects with the application stress shown by the solid line at a point 221. When the steel strip 20 has the yield stress C (MPa), the steel strip 20 plastically deforms on the radially outer side of the point 221 and elastically deforms on the radially inner side of the point 221. The yield stress B (MPa) shown by the one-point chain line intersects with the application stress shown by the solid line at a point 222. When the steel strip 20 has the yield stress B (MPa), the steel strip 20 plastically deforms on the radially outer side of the point 222 and elastically deforms on the radially inner side of the point 222. The yield stress A (MPa) shown by the solid line intersects with the application stress shown by the solid line at a point 223. When the steel strip 20 has the yield stress A (MPa), the steel strip 20 plastically deforms on the radially outer side of the point 223 and elastically deforms on the radially inner side of the point 223.

Figure 5C:
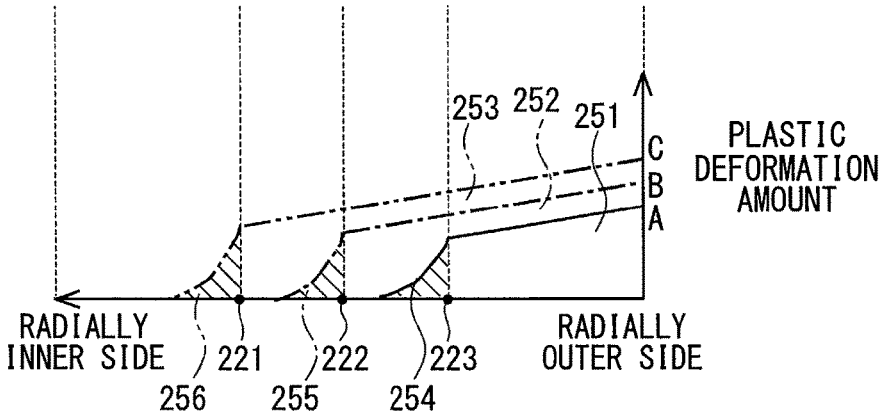

FIG. 5C shows the amount of plastic deformation of the steel strip 20 subsequent to the rolling bending work. The solid line represents the amount of deformation caused in the steel strip 20 of the yield stress A (MPa). The one-point chain line represents the amount of deformation caused in the steel strip 20 of the yield stress B (MPa). The two-point chain line represents the amount of deformation caused in the steel strip 20 of the yield stress C (MPa). The follow-up deformation amount 254 when the yield stress of the steel strip 20 is the yield stress A (MPa) is shown by the hatched area. The follow-up deformation amount 255 when the yield stress of the steel strip 20 is the yield stress B (MPa) is shown by the hatched area. The follow-up deformation amount 256 when the yield stress of the steel strip 20 is the yield stress C (MPa) is shown by the hatched area. Each of an inclination deformation amount 251, an inclination deformation amount 252, and an inclination deformation amount 253 represents an amount of inclination deformation caused when the steel strip 20 is rolled with the inclined portion.

The steel strip 20, which is processed with the rolling bending work by using the general compression roller 21, differs in the start position of the following deformation with respect to the board width direction, as the yield stress varies. Ratios of the deformation amount is represented with area ratios in FIG. 5C. Specifically, in FIG. 5C, a ratio of the inclination deformation amount 251 to the follow-up deformation amount 254 differs from a ratio of the inclination deformation amount 252 to the follow-up deformation amount 255. In addition, a ratio of the inclination deformation amount 251 to the follow-up deformation amount 254 differs from a ratio of the inclination deformation amount 253 to the follow-up deformation amount 256. Therefore, the curvature of the steel strip 20, which has been processed with the rolling bending work, differs for each of the steel strips 20 which are different in the yield stress.

Subsequently, the steel strip 20, which has been processed with the rolling bending work by using the rolling bending apparatus 10 according to the present embodiment, will be described.

Figure 6A:
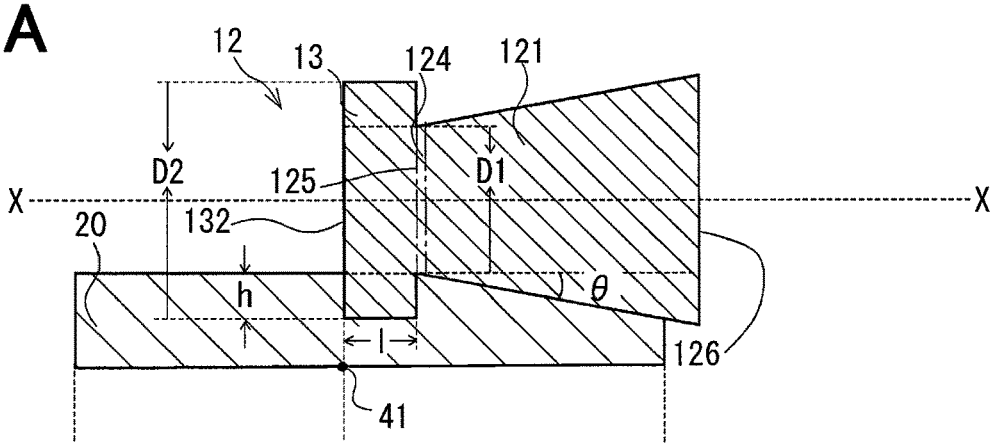
FIGS. 6A, 6B, 6C, and 6D are views showing a rolling bending work according to the first embodiment.
Figure 6B:
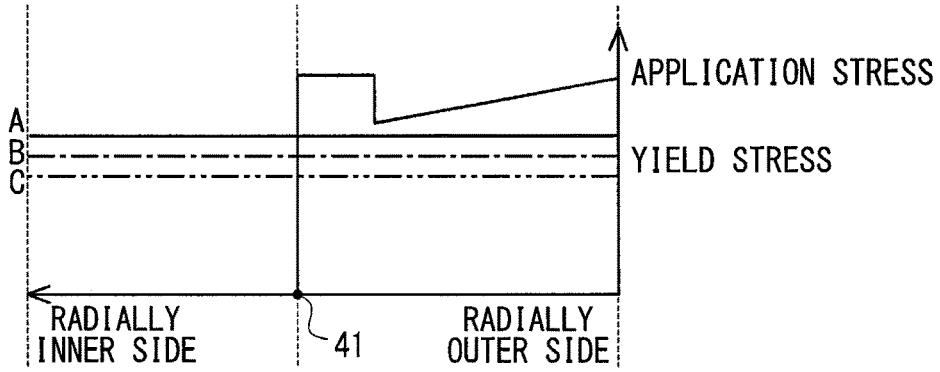

FIG. 6A is an explanatory view showing the steel strip 20 rolled by using the compression roller 12 of the present embodiment in a case where the yield stress of the steel strip 20 varies. The rolling work is performed on the steel strip 20 at a portion on the radially inner side of a point 41 with respect to the board width direction. FIG. 6B shows a relationship between the stress generated in the steel strip 20 and the position in the steel strip 20 with respect to the board width direction. The compression roller 12 generates stress, which is greater than the yield stress of the steel strip 20, in the steel strip 20 to plastically deform the steel strip 20. The yield stress A (MPa) shown by the solid chain line intersects with the application stress shown by the solid line at the point 41. The point 41 coincides with the boundary as shown in FIG. 6A. With respect to this boundary, the portion of the steel strip 20 on the radially outer side is processed with the rolling work. Each of the yield stress B (MPa) shown by the one-point chain line and the yield stress C (MPa) shown by the two-point chain line intersects with the application stress at the same point 41. The stress applied to the steel strip 20 by using the projected portion 13 is greater than the stress applied to the steel strip 20 by using the adjacent portion 124 of the column portion 121, which is adjacent to the projected portion 13. Compression force is not applied to the portion of the steel strip 20 on the radially inner side of the non-connecting surface 132, and the portion of the steel strip 20 is not processed with the rolling work. That is, the rolling work is terminated at the non-connecting surface 132.

Figure 6C:
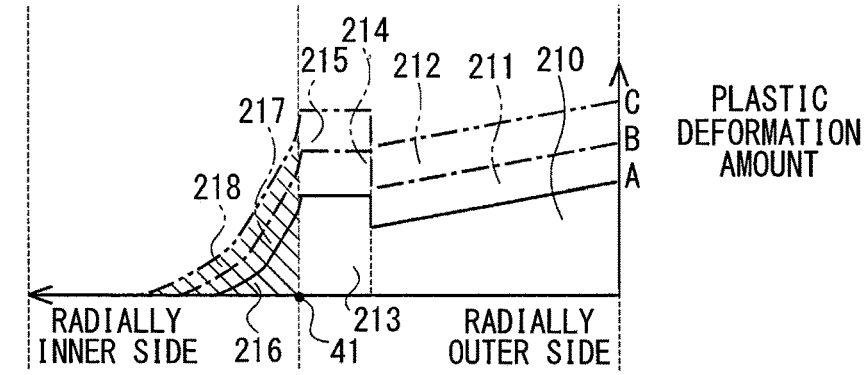

FIG. 6C shows the amount of plastic deformation of the steel strip 20 with respect to the board width direction subsequent to the rolling bending work. The solid line represents the amount of deformation caused in the steel strip 20 of the yield stress A (MPa). The one-point chain line represents the amount of deformation caused in the steel strip 20 of the yield stress B (MPa). The two-point chain line represents the amount of deformation caused in the steel strip 20 of the yield stress C (MPa). A portion of the steel strip 20 of the yield stress A (MPa) is rolled with the column portion 121 and is deformed by an inclination deformation amount 210. A portion of the steel strip 20 of the yield stress B (MPa) is rolled with the column portion 121 and is deformed by an inclination deformation amount 211. A portion of the steel strip 20 of the yield stress C (MPa) is rolled with the column portion 121 and is deformed by an inclination deformation amount 212. A portion of the steel strip 20 of the yield stress A (MPa) is rolled with the projected portion 13 and is deformed by a concentrated deformation amount 213. A portion of the steel strip 20 of the yield stress B (MPa) is rolled with the projected portion 13 and is deformed by a concentrated deformation amount 214. A portion of the steel strip 20 of the yield stress C (MPa) is rolled with the projected portion 13 and is deformed by a concentrated deformation amount 215. A portion of the steel strip 20 of the yield stress A (MPa) causes follow-up deformation following the concentrated deformation by a follow-up deformation amount 216 as hatched. A portion of the steel strip 20 of the yield stress B (MPa) causes follow-up deformation following the concentrated deformation by a follow-up deformation amount 217 as hatched. A portion of the steel strip 20 of the yield stress C (MPa) causes follow-up deformation following the concentrated deformation by a follow-up deformation amount 218 as hatched. The projected portion 13 terminates the rolling work on the steel strip 20 at the point 41 with respect to the board width direction. Therefore, the follow-up deformation starts at the point 41, regardless of the yield stress.

In FIG. 6C, a ratio of a total deformation, which is the sum of the inclination deformation amount 210 and the concentrated deformation amount 213, to the follow-up deformation amount 216 is substantially the same as a ratio of a total deformation, which is the sum of the inclination deformation amount 211 and the concentrated deformation amount 214, to the follow-up deformation amount 217. In addition, a ratio of a total deformation, which is the sum of the inclination deformation amount 210 and the concentrated deformation amount 213, to the follow-up deformation amount 216 is substantially the same as a ratio of a total deformation, which is the sum of the inclination deformation amount 212 and the concentrated deformation amount 215, to the follow-up deformation amount 218. Therefore, the curvature of the steel strip 20, which has been processed with the rolling bending work, becomes substantially constant for each of the steel strips 20 which are different in the yield stress.

Figure 6D:
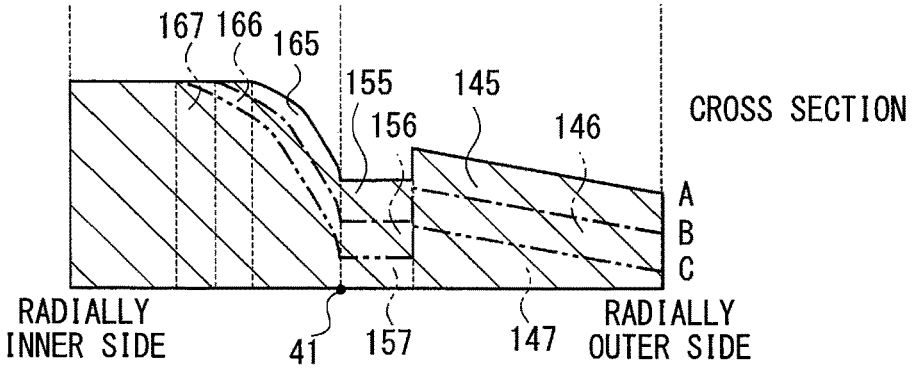

FIG. 6D shows a cross section of the steel strip 20, which has been processed with the rolling bending work. The solid line represents the cross section of the steel strip 20 of the yield stress A (MPa). The one-point chain line represents the cross section of the steel strip 20 of the yield stress B (MPa). The two-point chain line represents the cross section of the steel strip 20 of the yield stress C (MPa). An inclination deformed portion 145 represents the steel strip 20 of the yield stress A (MPa) and processed with the column portion 121. A concentrated deformed portion 155 represents the steel strip 20 of the yield stress A (MPa) and processed with the projected portion 13. An inclination deformed portion 146 represents the steel strip 20 of the yield stress B (MPa) and processed with the column portion 121. A concentrated deformed portion 156 represents the steel strip 20 of the yield stress B (MPa) and processed with the projected portion 13. An inclination deformed portion 147 represents the steel strip 20 of the yield stress C (MPa) and processed with the column portion 121. A concentrated deformed portion 157 represents the steel strip 20 of the yield stress C (MPa) and processed with the projected portion 13.

A follow-up deformed portion 165 represents the steel strip 20 of the yield stress A (MPa), which has caused the follow-up deformation following the concentrated deformed portion 155. A follow-up deformed portion 166 represents the steel strip 20 of the yield stress B (MPa), which has caused the follow-up deformation following the concentrated deformed portion 156. A follow-up deformed portion 167 represents the steel strip 20 of the yield stress C (MPa), which has caused the follow-up deformation following the concentrated deformed portion 157. All the follow-up deformed portions 165, 166, and 167 have started the follow-up deformation at the same point 41. The rolling work on the steel strip 20 has been terminated at the same point with respect to the board width direction, regardless of the yield stress of the steel strip 20. Therefore, even though the yield stress varies, the follow-up deformed portion starts constantly at the point 41. The follow-up deformed portions 165, 166, and 167 reduce in the amount of deformation toward the radially inside and show deformation in a shape of trailing of skirt. Since, the follow-up deformation starts at the position, the surface shapes of the follow-up deformed portions 165, 166, and 167 are similar to each other.

Figure 7:
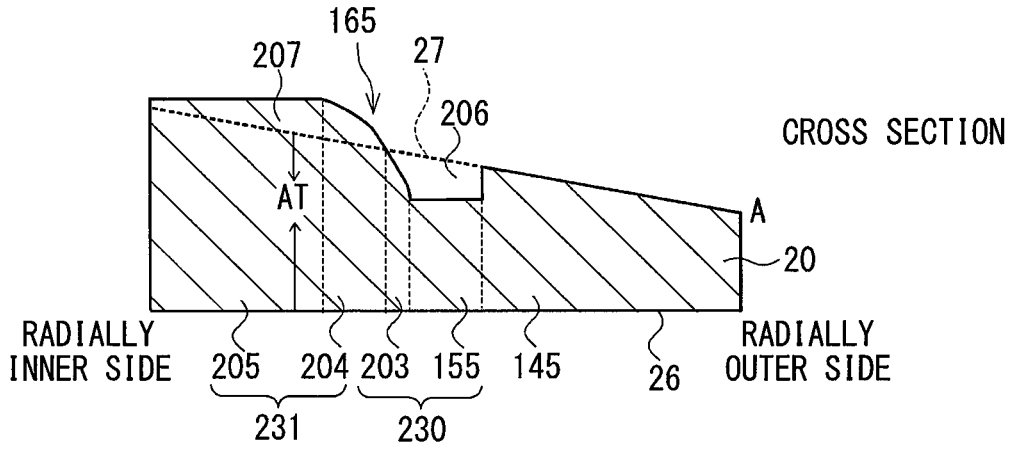
FIG. 7 is a sectional view showing a steel strip, which has been processed with the rolling bending work according to the first embodiment.

FIG. 7 shows a cross section of the processed steel strip 20 of the yield stress A (MPa). The follow-up deformed portion 165 of the steel strip 20, which has been processed with the rolling bending work, includes a first follow-up deformed portion 203 and a second follow-up deformed portion 204. The steel strip 20 includes a non-deformed portion 205. The dotted lines show boundaries among the portions. An imaginary surface 27 shown by the dotted line represents an extension of the surface of the inclination deformed portion 145, which has been processed with the column portion 121, toward the radially inner side. A target thickness AT is a length between the imaginary surface 27 and a rear surface 26 of the steel strip 20, which has been processed, with respect to the board width direction. The target thickness AT is the length at a position inside the steel strip 20, which has been processed, in the thickness direction.

The first follow-up deformed portion 203 is a portion, which has deformed following the concentrated deformed portion 155 processed with the projected portion 13. The first follow-up deformed portion 203 has a thickness less than the target thickness AT. The second follow-up deformed portion 204 is a portion, which has deformed following the concentrated deformed portion 155 processed with the projected portion 13. The second follow-up deformed portion 204 has a thickness greater than the target thickness AT. The non-deformed portion 205 is a portion which has not deformed.

A thin portion 230 is a combination of the concentrated deformed portion 155 and the first follow-up deformed portion 203. The thin portion 230 has a thickness entirely less than the target thickness AT. A thick portion 231 is a combination of the second follow-up deformed portion 204 and the non-deformed portion 205. The thick portion 231 has a thickness entirely greater than the target thickness AT.

In the cross section along the direction perpendicular to the sending direction, an area (first area) 206 is surrounded by the surface line of the thin portion 230 and a surface line, which is represented by the imaginary surface 27. In the cross section, an area (second area) 207 is surrounded by the surface line of the thick portion 231 and a surface line, which is represented by the imaginary surface 27. The area 206 is substantially the same as the area 207. That is, a portion thicker than the target thickness AT and a portion thinner than the target thickness AT are balanced with each other. In other words, the portion on the radially outer side, which has caused large deformation, and the portion on the radially inner side, which has caused small deformation, compensate with each other. Consequently, the steel strip 20 are deformed on the whole by a deformation amount about the target thickness AT on average.

As follows, an effect of the rolling bending work, which is processed on the steel strip 20 by using the rolling bending apparatus 10 of the present embodiment, will be described. (a) The projected portion 13 terminates the rolling work at the intermediate point with respect to the board width direction of the steel strip 20. The present feature sets the start position of the follow-up deformed portions 165, 166, and 167 at the constant point in the steel strip 20 with respect to the board width direction, regardless of the yield stress of the steel strip 20. Therefore, even though the yield stress of the steel strip 20 varies, the feature enables to constantly maintain the ratio of the amount of deformation of the portion, which is processed with the compression roller 12, to the follow-up deformation amount, regardless of the yield stress of the steel strip 20. Therefore, even in case where the yield stress of the steel strip 20 varies, the curvature of the steel strip 20 can be maintained at a constant curvature. (b) The steel strip 20, which has been processed with the rolling bending work, includes the inclination deformed portion 145 processed with the column portion 121. The imaginary surface 27 is the extension of the surface of the inclination deformed portion 145 toward the radially inner side. The steel strip 20, which has been processed, has the rear surface 26. The target thickness AT is the length between the imaginary surface 27 and the rear surface 26 in the thickness direction. The steel strip 20, which has been processed, includes the thick portion 231 and the thin portion 230. The thick portion 231 has the thickness greater than the target thickness AT. The thin portion 230 has the thickness less than the target thickness AT. Assuming a case where, for example, the steel strip 20 causes excessive deformation beyond a target, the steel strip 20 may have an uneven thickness. Consequently, the steel strip 20, which has been processed with the rolling bending work, may cause wrinkles. To the contrary, the feature enables to cause a portion, which has deformed by the large deformation amount, and a portion, which has deformed by the small deformation amount, to offset each other. Consequently, the feature enables the steel strip 20, which has been processed, to deform on the whole by a deformation amount about the target thickness AT on average. In this way, the feature enables the rolling bending work reducing or avoiding wrinkles. (c) In the cross-section perpendicular to the sending direction of the steel strip 20, which has been processed with the rolling bending work, the area 206 is surrounded by the surface line of the thin portion 230 and the surface line, which is represented by the imaginary surface 27. In the cross section, the area 207 is surrounded by the surface line of the thick portion 231 and the surface line, which is represented by the imaginary surface 27. The area 206 is substantially the same as the area 207. That is, in the steel strip 20, an amount of a portion, which has the thickness greater than the target thickness AT, and an amount of a portion, which has the thickness less than the target thickness AT, are equal to each other. Consequently, the amount of deformation meets the target thickness AT on average. The feature enables the rolling bending work stably with less wrinkles.

Second Embodiment

Figure 8:
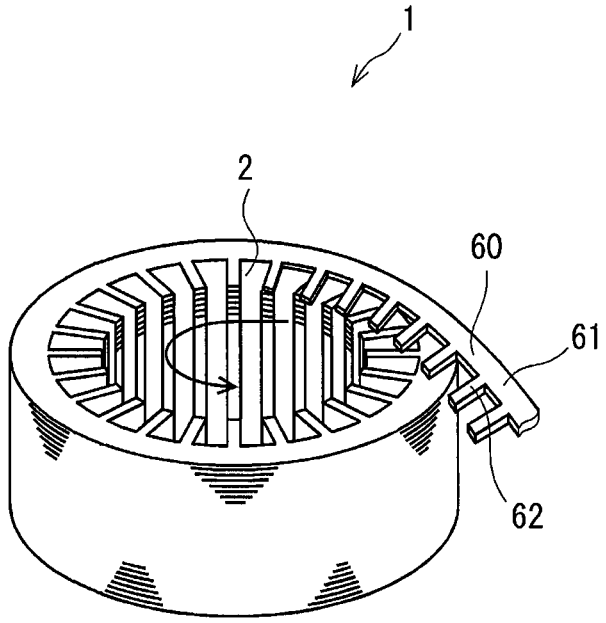
FIG. 8 is a perspective view showing a stator of a rotary device according to a second embodiment.

As follows, the second embodiment of the present disclosure will be described with reference to FIGS. 8 to 10. Specifically, the following description is directed to manufacturing of a stator for a rotary device by using the rolling bending apparatus 10 with the rolling bending process according to the first embodiment. As shown in the perspective view of FIG. 8, a stationary iron core 1 is formed by laminating a steel strip 60 in a spiral form. The steel strip 60 is in a comb shape and has magnetism. The steel strip 60 is segmented by a teeth portion 62. The steel strip 60, which has been laminated continuously in the spiral form, is the stationary iron core 1 having slots 2 on the radially inside. The slots 2 are to be inserted with a winding (not shown). The steel strip 60 has a portion, which is not formed with the teeth portion 62, forms a yoke portion 61.

Figure 9:
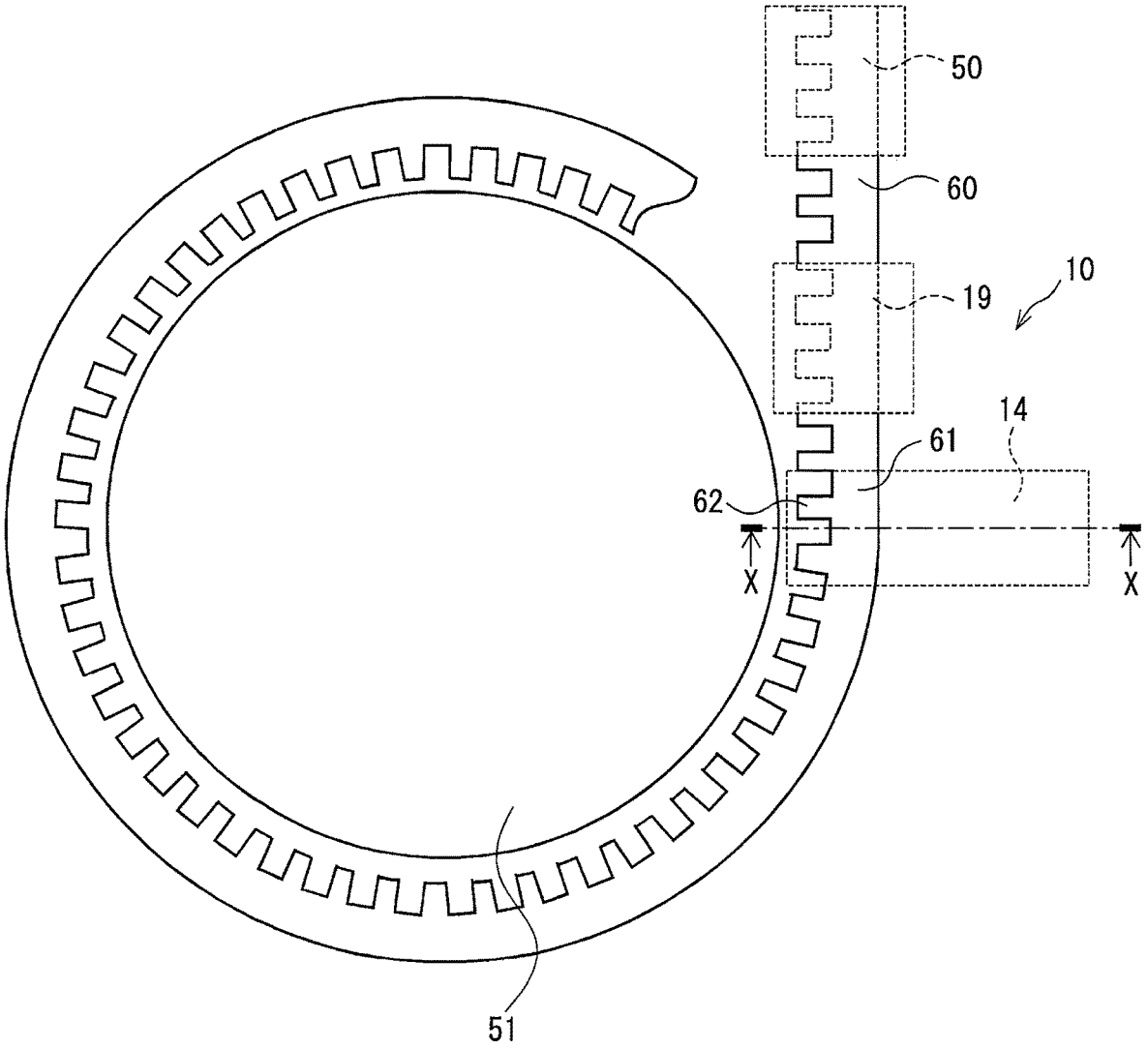
FIG. 9 is a plan view showing a rolling bending apparatus according to the second embodiment.
Figure 10:
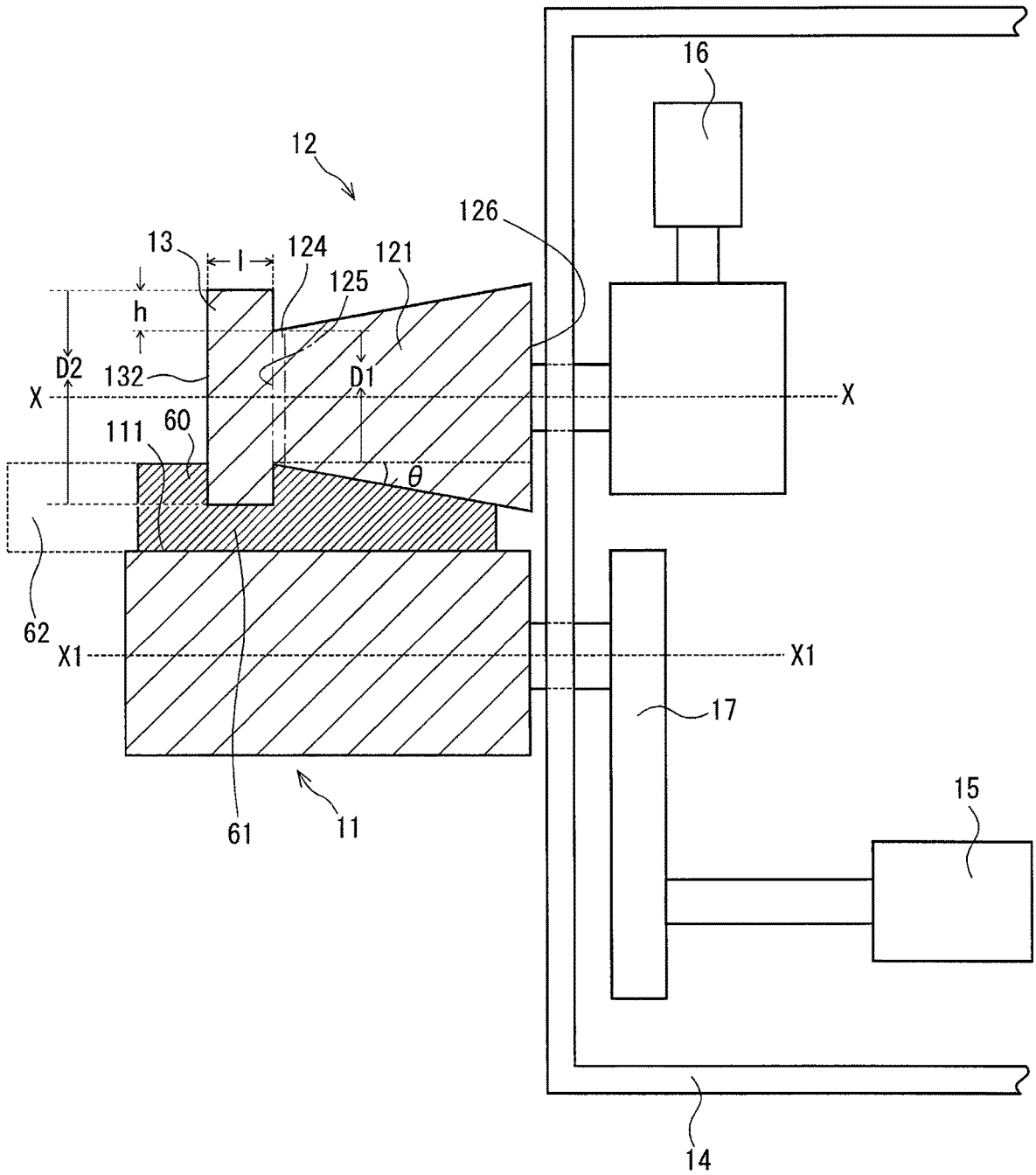
FIG. 10 is a sectional view taken along a line X-X in FIG. 9.

The plan view in FIG. 9 shows a state where the steel strip 60 is processed with the rolling bending apparatus 10. Its cross section is shown in FIG. 10. The compression working force is selectively applied to the yoke portion 61. The teeth portion 62 is kept away from the compression working force. In FIG. 10, the dotted line represents the teeth portion 62. In the steel strip 60, which has been processed with the rolling bending work, the yoke portion 61, is located on the radially outer side, and the teeth portion 62 is located on the radially inner side.

As follows, the rolling bending process, which is to produce the stator of the rotary device by laminating the steel strip 60 in the annular form, will be described. A preparation process at step S1 will be described. The steel strip 60, which includes the teeth portion 62, is prepared. The teeth portion 62 is worked through, for example, a stamping process by using a punch. A feeding process at step S2 will be described. The steel strip 60 is aligned with the feeder guide 19 such that the first direction coincides with the direction, which is directed from the yoke portion 61 toward the teeth portion 62. The steel strip 60 is guided and fed into the rolling bending apparatus 10 such that the projected portion 13 rolls the yoke portion 61. Step S3 to step S5 are the same as those of the first embodiment.

As follows, an effect of the manufacturing of the stator of the rotary device through the rolling bending work by using the rolling bending apparatus 10 of the present embodiment will be described. (d) The process enables to reduce fluctuation in the curvature, which is produced through the bending work, even if a yield stress characteristic of the steel strip 60 varies. Therefore, the process enables to reduce variation in the diameter of the steel strip 20, which has been rolled up. Therefore, the process enables to reduce variation in the position of the teeth portion 62 of the steel strip 60. Therefore, the process facilitates insertion of the winding into the teeth portion 62. In addition, the process enables to protect an insulation of the winding from scratching. (e) The process enables to reduce a gap between the winding and the teeth portion 62. Therefore, the process enables to increase an occupancy rate of the winding, thereby to enhance an output power of the rotary device. (f) The process enables to reduce wrinkling in the steel strip 60. Therefore, the process facilitates lamination of the steel strip 60 tightly with reduced gap, thereby to increase the density of the iron core. Therefore, the process enables to enhance an output power of the rotary device. (g) The process enables to enhance accuracy of the circularity of the wound steel strip 20, thereby to reduce an air gap to reduce a loss of a magnetic circuit. This, the process enables to enhance an output power of the rotary device.

Figure 11A:
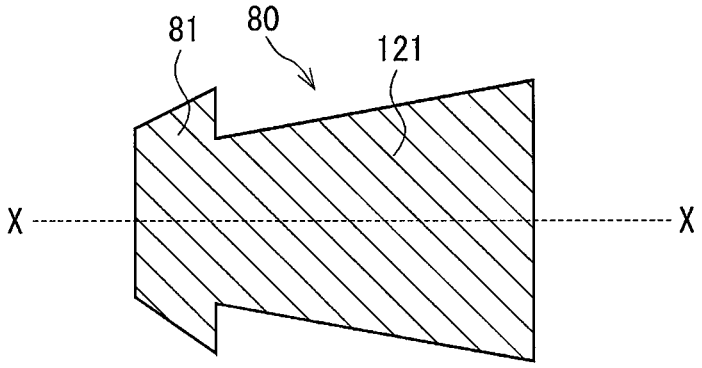
FIGS. 11A, 11B and 11C are views showing compression roller according to other embodiments.

Other Embodiment (a) A compression roller 80 shown in FIG. 11A may be employed in replace of the compression roller 12 according to the first embodiment. The compression roller 80 includes an projected portion 81 as a second contact portion. The projected portion 81 has an inclined surface, which inclines radially inward toward the rotational axis X along the direction from the column portion 121 toward the projected portion 81. This configuration defines the start position of deformation at a constant point with respect to the width direction, thereby to reduce variation in the curvature of the steel strip 20, which has been processed.

Figure 11B:
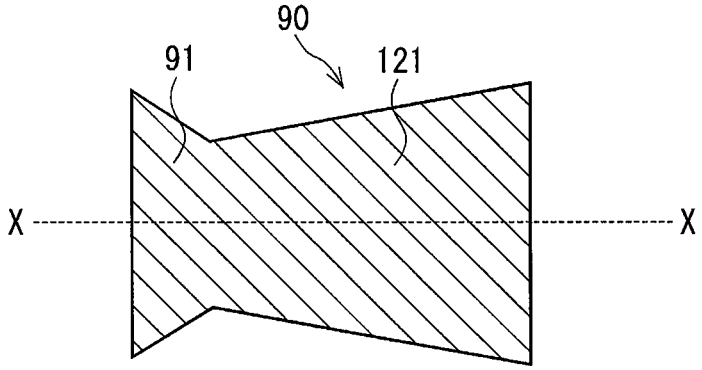

A compression roller 90 shown in FIG. 11B may be employed in place of the compression roller 12 according to the first embodiment. The compression roller 90 includes an projected portion 91 as a second contact portion. The projected portion 91 has an inclined surface, which inclines radially outward away from the rotational axis X along the direction from the column portion 121 toward the projected portion 91. This configuration also defines the start position of deformation at a constant point with respect to the width direction, thereby to reduce variation in the curvature of the steel strip 20, which has been processed.

Figure 11C:
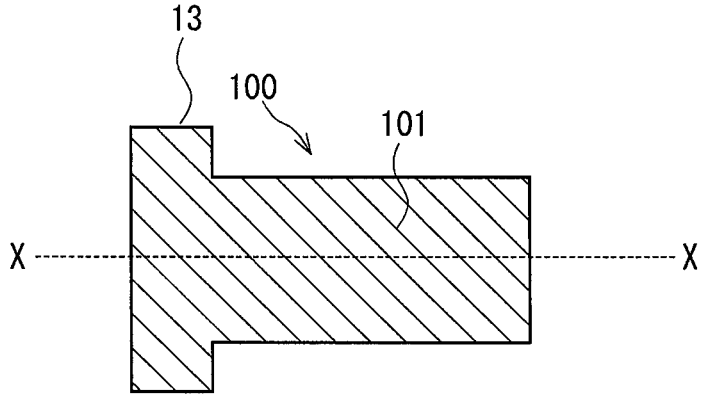

A compression roller 100 shown in FIG. 11C may be employed in place of the compression roller 12 according to the first embodiment. The compression roller 100 includes a column portion 101 as a first contact portion. The column portion 101 does not have an inclined surface. This configuration also defines the start position of deformation at a constant point with respect to the width direction, thereby to reduce variation in the curvature of the steel strip 20, which has been processed.

(b) In the first and second embodiments, the driving roller 11 has the cylindrical surface. In replace with this configuration, the driving roller may be a roller having an inclined surface.

(c) In the first and second embodiments, the rotational axis center X1 of the driving roller 11 and the rotational axis center X of the compression roller 12 are in parallel with each other. In replace with this configuration, the rotational axis center of the driving roller 11 and the rotational axis center of the compression roller 12 may be inclined to each other.

The processing method according to a first aspect of the present disclosure is to perform the rolling bending work on the steel strips 20 and 60. The processing method includes the feeding process S2, the rolling process S3, and the sending-out process S4. The feeding process S2 includes feeding a steel strip between the driving roller 11 and the compression roller 12. The rolling process S3 includes causing the driving roller and the compression roller to generate a stress greater than the yield stress in the steel strip and elongating one periphery portion 28 of the steel strip more than the other periphery portion 29 of the steel strip in the sending direction. The one periphery portion 28 of the steel strip is on one side with respect to the board width direction. The other periphery portion 29 of the steel strip is on the other side with respect to the board width direction. The sending-out process S4 includes sending out the steel strip from the work space between the driving roller and the compression roller. The compression roller used in the rolling process includes the first contact portion 121 and the second contact portion 13. The first contact portion 121 rolls the steel strip. The second contact portion 13 extends from the end 124 of the first contact portion in the roller axial direction. The outer diameter D1 of the end of the first contact portion and the outer diameter D2 of the second contact portion have a relationship where the outer diameter D1 is less than the outer diameter D2.

The second contact portion of the compression roller exerts a large compression force on the steel strip and forms the concentrated deformed portion. The follow-up deformed portion deforms following the concentrated deformed portion. The start position of the follow-up deformed portion is constant with respect to the board width direction of the steel strip. Therefore, the ratio of the total deformation, which is the sum of the amount of deformation of the inclination deformed portion and the amount of deformation of the concentrated deformed portion, to the amount of deformation of the follow-up deformed portion becomes constant even if the yield stress of the steel strip varies. Thus, even if the yield stress of the steel strip varies, the curvature of the steel strip, which has been processed with the rolling bending work, becomes constant.

The rolling bending apparatus 10 according to a second aspect of the present disclosure bends the steel strips 20 and 60 in the board width direction. The rolling bending apparatus 10 includes the driving roller 11, the compression roller 12, and the compression part 16. The driving roller 11 receives torque from the actuator 15 and feeds the steel strip. The compression roller 12 includes the first contact portion 121 and the second contact portion 13. The first contact portion 121 compresses the steel strip. The second contact portion 13 extends from the end 124 of the first contact portion in the roller axial direction. The outer diameter D1 of the end of the first contact portion and the outer diameter D2 of the second contact portion have the relationship where the outer diameter D1 is less than the outer diameter D2. The compression part 16 is configured to move the compression roller toward the driving roller such that the first contact portion and the second contact portion generate a stress greater than the yield stress in the steel strip.

The rolling bending apparatus causes the first contact portion and the second contact portion to generate a stress greater than the yield stress of the steel strip by using the compression part. The second contact portion thereby forms the concentrated deformed portion in the steel strip. The start position of the follow-up deformed portion, which follows the concentrated deformed portion, becomes constant with respect to the board width direction of the steel strip. The total deformation is the sum of the amount of deformation of the inclined-deformed portion, which is processed with the first contact portion, and the amount of deformation of the concentrated deformed portion. The ratio of the total deformation to the amount of deformation of the follow-up deformed portion becomes constant even if the yield stress of the steel strip varies. Therefore, even if the yield stress of the steel strip varies, the curvature of the steel strip, which has been processed with the rolling and bending work, becomes constant.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A rolling bending method for rolling a steel strip between a driving roller and a compression roller while bending the steel strip in a width direction of the steel strip, the method comprising: feeding, in a feeding process, the steel strip between the driving roller and the compression roller; compressing, in a rolling process, the steel strip by using the driving roller and the compression roller to generate a stress greater than a yield stress in the steel strip to elongate a first periphery portion of the steel strip more than a second periphery portion of the steel strip in a sending direction, the first periphery portion and the second periphery portion facing each other along the width direction; and sending out, in a sending-out process, the steel strip from a work space between the driving roller and the compression roller, wherein the compression roller includes: a first contact portion to compress the steel strip; and a second contact portion extending from an end of the first contact portion in an axial direction of the compression roller, and the first contact portion is conically tapered toward the second contact portion, and the end of the first contact portion has an outer diameter less than an outer diameter of the second contact portion.

2. The rolling bending method according to claim 1, wherein the steel strip after being rolled includes an inclination deformed portion having an inclined surface, the inclined surface has been in contact with the first contact portion of the compression roller during the rolling process and inclines from a first side toward a second side along the width direction, an imaginary surface is an extension of the inclined surface of the inclination deformed portion and extends from the inclined surface toward the second side, a target thickness is a length between the imaginary surface and a rear surface of the steel strip in a thickness direction of the steel strip, and the steel strip after being rolled further includes:

a thin portion having a thickness less than the target thickness; and a thick portion having a thickness greater than the target thickness.

3. The rolling bending method according to claim 2, wherein the steel strip after being rolled has a cross-section perpendicular to the sending direction, the cross-section includes;

a first area that is surrounded by a surface line, which represents the imaginary surface, and a surface line, which represents a surface of the thin portion; and a second area that is surrounded by a surface line, which represents the imaginary surface, and a surface line, which represents a surface of the thick portion, and the first area is equal to the second area.

4. The rolling bending method according to claim 1, wherein the steel strip includes a yoke portion and a plurality of teeth portions, the yoke portion is in a linear shape and has a rectangular cross section, and the teeth portions are projected from the yoke portion in the width direction of the steel strip.

5. The rolling bending method according to claim 1, wherein the first periphery portion and the second periphery portion of the steel strip face each other along the width direction, the first periphery portion is on a first side along the width direction, the second periphery portion is on a second side along the width direction.

6. The rolling bending method according to claim 2, wherein the first contact portion of the compress roller compresses the first periphery portion, and the inclination deformed portion is formed in the first periphery portion.

7. The rolling bending method according to claim 2, wherein the thin portion is located between the inclination deformed portion and the thick portion along the width direction, and the imaginary surface extends from an end of the inclined surface adjacent to the thin portion toward the thick portion over the thin portion.

8. The rolling bending method according to claim 2, wherein the steel strip has a first surface and a second surface facing each other along the thickness direction of the steel strip, the compression roller compresses the steel strip from the first surface toward the second surface, in a cross section perpendicular to the sending direction:

a first area is surrounded by the imaginary surface and the first surface in the thin portion; and a second area is surrounded by the imaginary surface and the first surface in the thick portion, and the first area is equal to the second area.

9. The rolling bending method according to claim 1, wherein the steel strip after being rolled includes a non-deformed portion that remains without being deformed during the rolling process.

* * * * *